US010704245B2

(12) United States Patent
Marcell

(10) Patent No.: US 10,704,245 B2
(45) Date of Patent: Jul. 7, 2020

(54) DEVICE FOR CONCEALING AN ARTICLE

(71) Applicant: Stacy L. Marcell, Tucson, AZ (US)

(72) Inventor: Stacy L. Marcell, Tucson, AZ (US)

( * ) Notice: Subject to any disclaimer, the term of this patent is extended or adjusted under 35 U.S.C. 154(b) by 0 days.

(21) Appl. No.: 14/503,972

(22) Filed: Oct. 1, 2014

(65) Prior Publication Data

US 2015/0090717 A1 Apr. 2, 2015

Related U.S. Application Data

(60) Provisional application No. 61/960,972, filed on Oct. 2, 2013.

(51) Int. Cl.

| | |
|---|---|
| ***E03D 9/00*** | (2006.01) |
| ***A47K 17/00*** | (2006.01) |
| ***A47B 81/02*** | (2006.01) |

(52) U.S. Cl.

CPC ..... *E03D 9/00* (2013.01); *A47B 81/02* (2013.01); *A47K 17/00* (2013.01)

(58) Field of Classification Search

CPC ..... A47K 17/00; A47K 11/10; A47B 81/02; E03D 9/00

See application file for complete search history.

(56) References Cited

U.S. PATENT DOCUMENTS

| | | | | |
|---|---|---|---|---|
| 4,273,392 | A * | 6/1981 | Stinson | 312/42 |
| 5,040,679 | A | 8/1991 | Rehmann | |
| 5,927,492 | A * | 7/1999 | Moore | 206/349 |
| 6,035,456 | A * | 3/2000 | Taylor | E03C 1/308 206/349 |
| 6,038,709 | A * | 3/2000 | Kent | 4/255.05 |
| D457,277 | S * | 5/2002 | Poston | D32/14 |
| 2002/0100705 | A1* | 8/2002 | Phillips et al. | 206/349 |
| 2003/0226777 | A1* | 12/2003 | Benson | 206/349 |
| 2005/0028258 | A1* | 2/2005 | Nasco | 4/255.01 |
| 2008/0135432 | A1 | 6/2008 | Cortinas | |
| 2009/0000967 | A1* | 1/2009 | Shafik | 206/216 |
| 2010/0065564 | A1* | 3/2010 | Lai | 220/23.91 |
| 2013/0015079 | A1* | 1/2013 | Arzoumanian | 206/6.1 |

OTHER PUBLICATIONS

TreeHugger, "Toilet Trees", www.treehugger.com/bathroom-design/toilet-trees.html, published Mar. 30, 2005, 3 pages.

Ellie Designs, LLC, "Plungees", web.archive.org/web/20050210140932/http://plungees.com/index.php, published Feb. 10, 2005, 1 page.

* cited by examiner

*Primary Examiner* — Fenn C Mathew

*Assistant Examiner* — Jennifer Castriotta

(74) *Attorney, Agent, or Firm* — University of Arizona IP Law Clinic

(57) ABSTRACT

An ornamental cover for concealing an article includes an elongated shaft having a proximal end and a distal end, and a base member disposed at the proximal end of the elongated shaft. The elongated shaft may extend distally from an upper surface of the base member, while a lower surface of the base member defines an opening for receiving an upper portion of the article into the elongated shaft. A perimeter of the base member may be shaped to fit an opening of a container sized to receive a lower portion of the article.

14 Claims, 18 Drawing Sheets

Figure IA

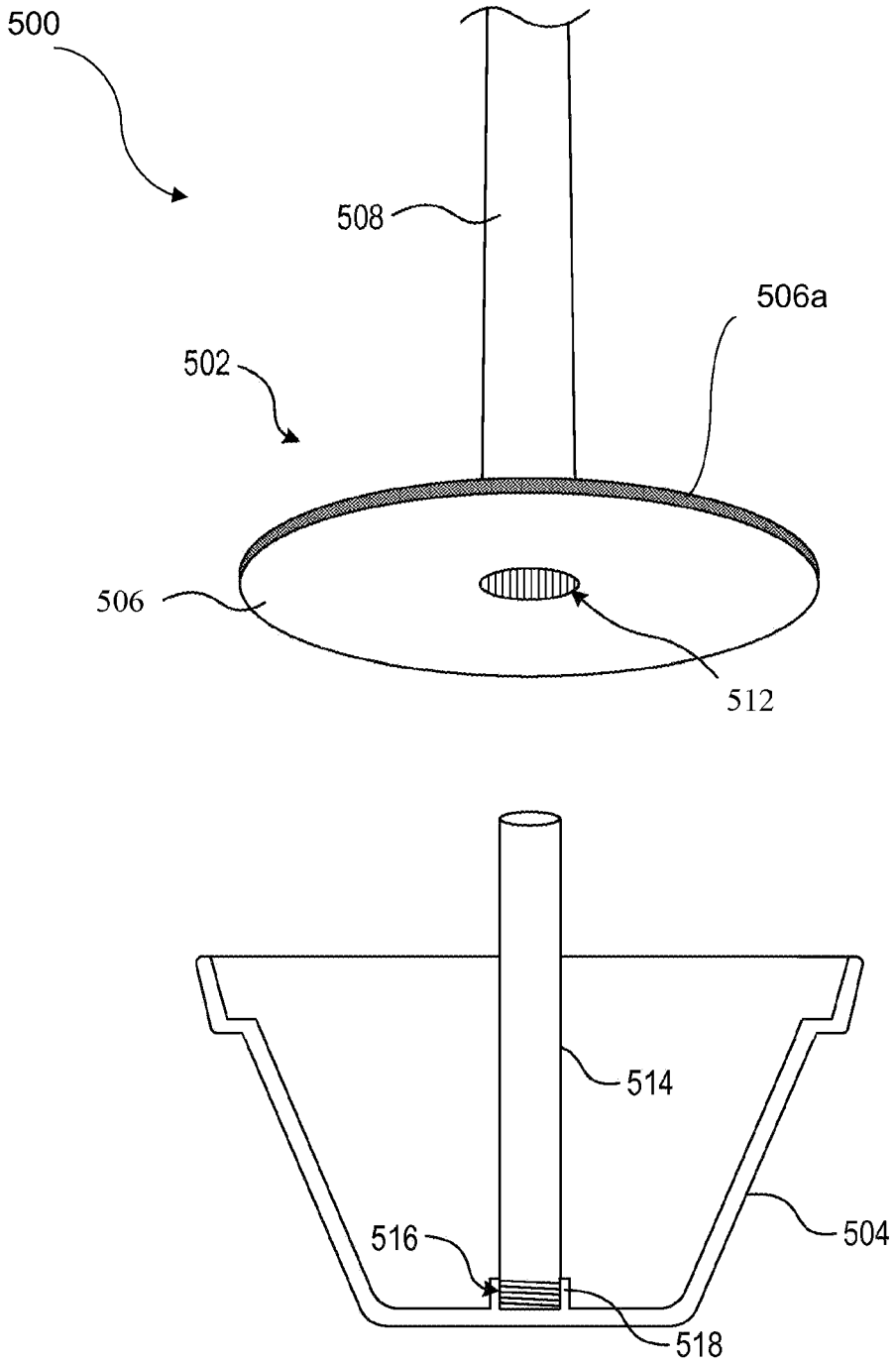
Figure 5A (Amended)

DEVICE FOR CONCEALING AN ARTICLE

CROSS-REFERENCE TO RELATED APPLICATION

This application claims the benefit of priority of U.S. Provisional Patent Application No. 61/960,972, filed Oct. 2, 2013, which is hereby incorporated by reference herein in its entirety.

TECHNICAL FIELD

This disclosure relates to the field of ornamental devices for concealing articles.

BACKGROUND

Many useful household articles often detract from the aesthetic appeal of the room in which the article is located. This is often the case for articles such as plungers and toilet brushes that, while convenient to place at or near the location of use, are unsanitary as well as unsightly. While these types of tools may be hidden away in containers, the containers may also be unsightly as well as serve as a reminder that the article is still present.

SUMMARY

The following presents a simplified summary of various aspects of this disclosure in order to provide a basic understanding of such aspects. This summary is not an extensive overview of the disclosure. It is intended to neither identify key or critical elements of the disclosure, nor delineate any scope of the particular implementations of the disclosure or any scope of the claims. Its sole purpose is to present some concepts of the disclosure in a simplified form as a prelude to the more detailed description that is presented later.

In one aspect of the present disclosure, an ornamental cover includes a first elongated shaft having a first proximal end and a first distal end, and a base member disposed at the first proximal end of the first elongated shaft. The base member has an upper surface and a lower surface. In one implementation, the first elongated shaft extends distally from the upper surface of the base member. In one implementation, the lower surface of the base member defines a first opening for receiving a first upper portion of a first article into the first elongated shaft. In one implementation, a perimeter of the base member is shaped to fit an opening of a container sized to receive a first lower portion of the first article.

In another aspect of the present disclosure, a device for concealing one or more articles includes a container. The container has a base, at least one sidewall extending from the base, and an opening defined by the at least one sidewall. In one implementation, the device includes a dowel coupled to the base or the at least one sidewall, in which a portion of the dowel extends past the one or more sidewalls and through the opening. In one implementation, the device includes an ornamental cover shaped to fit the opening, in which the portion of the dowel is received into an elongated shaft of the ornamental cover when the ornamental cover is covering the opening.

In yet another aspect of the present disclosure, a method includes providing a container and inserting an article into the container such that a lower portion of the article contacts a bottom surface of the container and an upper portion of the article extends out through an opening of the container. In one implementation, the method further includes covering the article with an ornamental cover such that the upper portion of the article is received through a base member of the ornamental cover and into an elongated shaft of the ornamental cover. In one implementation, the base member is sized to fit the opening of the container.

BRIEF DESCRIPTION OF THE DRAWINGS

The present disclosure is illustrated by way of example, and not by way of limitation, in the figures of the accompanying drawings, in which:

FIG. 1A illustrates an ornamental device for concealing an article in accordance with an implementation of the disclosure;

FIG. 5A illustrates a cross sectional view of an ornamental device utilizing a dowel to secure an ornamental cover in accordance with an implementation of the disclosure;

DETAILED DESCRIPTION

Aspects and implementations of the present disclosure are directed to an ornamental device for concealing an article, such as a handled tool. The ornamental device includes an ornamental cover that easily slips over the article while disguising it as a potted houseplant, for example, while making it accessible for quick access. The ornamental cover may include a shaft with a hollow interior. The shaft may serve as a handle for grasping the cover. The cover may also include real or artificial plant materials (e.g., colored fabrics) affixed thereto (e.g., using glue or other adhesives), as well as other ornamental elements (e.g., signs, lights, air fresheners, etc.). The container may be a common plastic or ceramic pot for planting, and the cover may be sized to fit various types of containers in order to accommodate articles as small as toilet brushes, flyswatters, and whisk brooms and articles as large as mops, brooms, and vacuum cleaners.

As used herein, the term "article" refers to any physical object that is of a size and/or shape that is suitable for storage within a container. Articles include, but are not limited to, household objects (e.g., car keys, mobile devices, paper documents, etc.), tools (e.g., handled tools, fasteners, construction tools, gardening equipment, etc.), containers (e.g., waste receptacles, food containers, etc.), and food items. Handled tools may include, but are not limited to, plungers, toilet brushes, mops, brooms, shovels, and scooping devices. An article may also include a dowel that may be used to provide structural support (e.g., a rod-shaped component). The dowel may be cylindrical dowel, a square dowel, a rectangular dowel, a triangular dowel, or any other suitable shape, and may be hollow, solid, or a combination thereof.

Figure 1B:
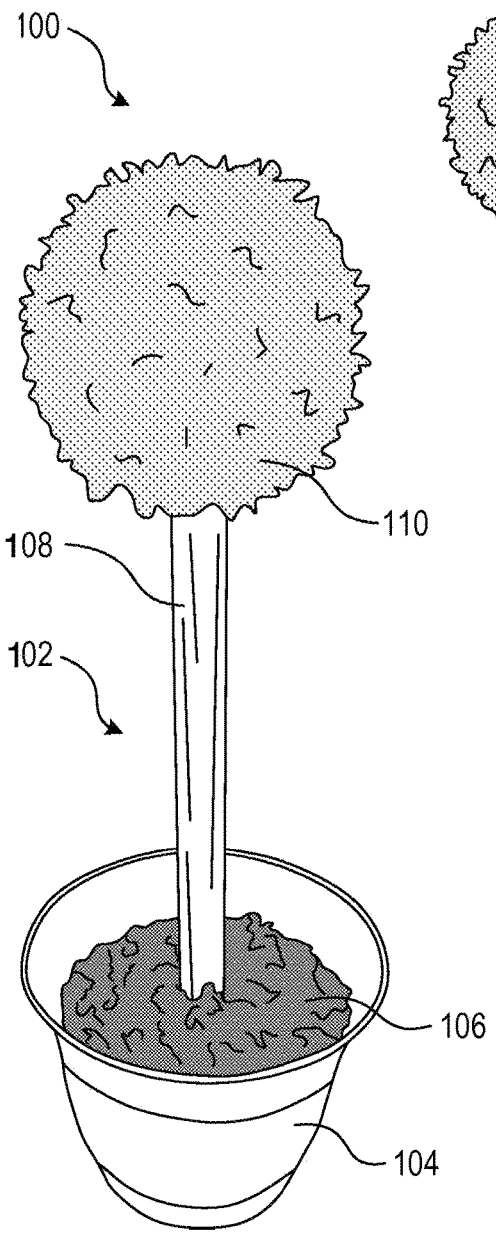
FIG. 1B illustrates an article revealed by removing an ornamental cover in accordance with an implementation of the disclosure.
Figure 1B:
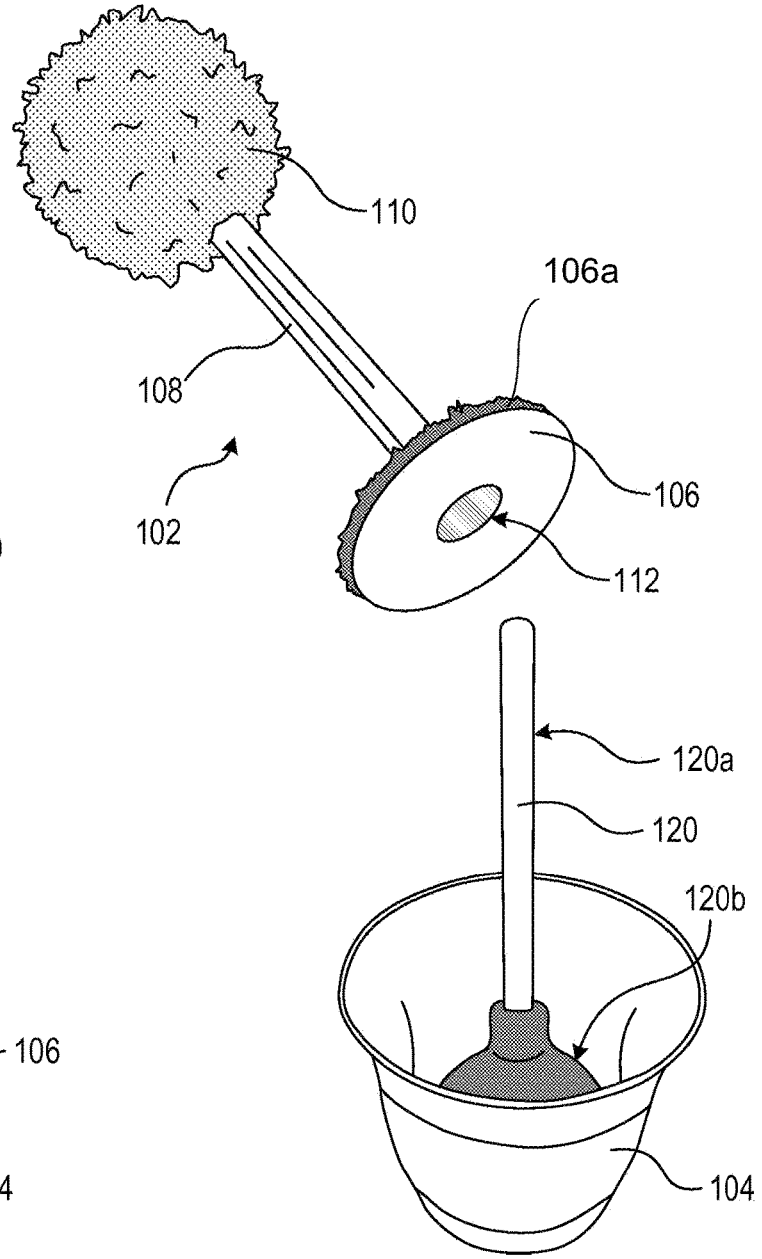

FIGS. 1A and 1B illustrate an ornamental device 100 used to conceal an article 120 (e.g., a plunger) in accordance with an implementation of the disclosure. The ornamental device includes an ornamental cover 102 and a container 104. In some implementations, the ornamental cover 102 and the container 104 are separate components. In other implementations, the ornamental cover 102 is coupled to the container 104, for example, by a hinged attachment site. The ornamental cover 102 includes a base member 106 having an upper surface and a lower surface. In some implementations, the upper surface of the base member 106 may be decorated to give the appearance of potting soil, grass, leaves, rocks, or any other material that may provide an aesthetic effect. An elongated shaft 108 extends from the upper surface of the base member 106. The elongated shaft 108 may serve as a handle that is decorated or disguised as a trunk of a tree, as illustrated.

A decorative element 110 is located at a distal end of the elongated shaft 108. In some implementations, the decorative element 110 may be, but is not limited to, a plant or portion thereof, an artificial plant or portion thereof, a light source, an air freshener, a sign, a mailbox, or a bird house, a basketball hoop, a statue, a figurine of an animal, a figurine of a human, a teepee, a bird perch, a fence post, a log, a chalk board, a dry erase board, a cork board, a message board, a rocket, a spaceship, a space shuttle, a flag pole, a tether ball pole, an oil rig, a surfboard, a golf club, a golf caddy, a newspaper box, a telephone pole, a stadium, stadium lights, a stop light, a clothesline, a satellite dish, an antenna, a diving board, a lifeguard chair, a field goal post, a baseball bat, a hockey stick, a sword, a pool cue, a ski pole, an umbrella, a bowling pin, a candy cane, a fire extinguisher, a guitar, a building, or combinations thereof. In some implementations, multiple decorative elements may be included, and may be attached to one or more of the elongated shaft 108 or the base member 106. In some implementations, the decorative element 110 may be attached to the elongated shaft by an adhesive (e.g., tape, glue, etc.) or a mechanical couple (e.g., tethered by a string or rope, a hook-and-loop fastener, a button, etc.). In some implementations, the base member 106 may include one or more reservoirs for containing objects or fluid therein. For example, an aromatic fluid may be placed in the reservoir. In some implementations, the elongated shaft 108 may be formed from a plastic tube (e.g., polyvinyl chloride tubing), a cardboard tube, or other suitable materials. In some implementations, the elongated shaft 108 and the base member 106 may be formed from single piece of material, for example, by forming a mold from a cast, 3D printing the base member 106 and elongated shaft (or the entire ornamental cover), or joining one or more materials together.

In some implementations, the elongated shaft 108 may have a hollow interior or a partially hollow interior depending on the type and/or shape of the article 120. In implementations in which the elongated shaft 108 is hollow or partially hollow, the base member 106 may define an opening 112 for at least partially receiving an upper portion 120*a* of the article 120 (e.g., a plunger handle) into the elongated shaft 108. A lower portion 120*b* of the article 120 may rest on a bottom interior surface of the container 104, or may be secured to the bottom interior surface or one or more sidewalls of the container 104.

Figure 2:
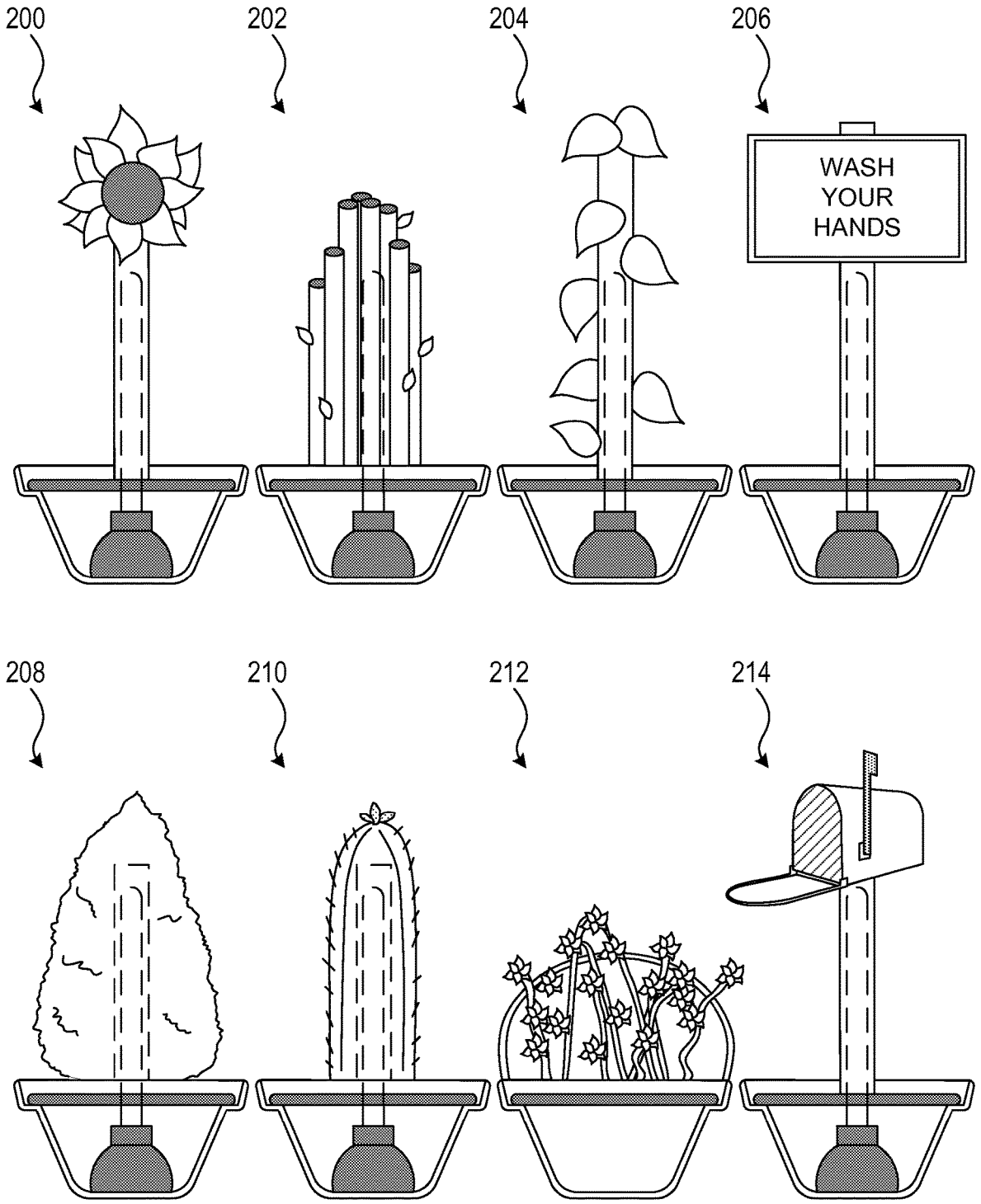
FIG. 2 illustrates different types of ornamental covers in accordance with various implementations of the disclosure.

FIG. 2 illustrates different types of ornamental devices 200, 202, 204, 206, 208, 210, 212, 214 in accordance with various implementations of the disclosure. Ornamental devices 200, 202, 204, 206, 208, 210, for example, may include real or artificial plant components (e.g., a bush, a tree, a cactus, a flower, reeds, a marijuana leaf, etc.). Ornamental device 212, in particular, may be a flower arrangement in which an elongated shaft has been omitted. Ornamental device 206 includes a sign, which may be any type of sign to produce an aesthetic or functional effect (e.g., a street sign, a crossing signs, notice/warning signs, a white board, a chalk board, a poster board, a cork board, a board for attaching adhesives, etc.). Other types of decorative elements may also be used, such as those that appear to be rested on a surface or planted beneath the surface or in a vessel (e.g., ornamental device 214). Examples include a mailbox (which may be an actual mailbox that conceals one or more outdoor tools or a fake mailbox that contains a toilet paper dispenser), a bird house, a lighthouse with an operational light source, a dart board, etc. In some implementations, an ornamental device may be used to store paper products, such as toilet paper. In some implementations, a container or base member of the ornamental device may further include an opening (e.g., a slit) from which the paper product may be dispensed. In some implementations, portions of an ornamental device may glow in the dark or be illuminated under ultraviolet light.

Figure 3:
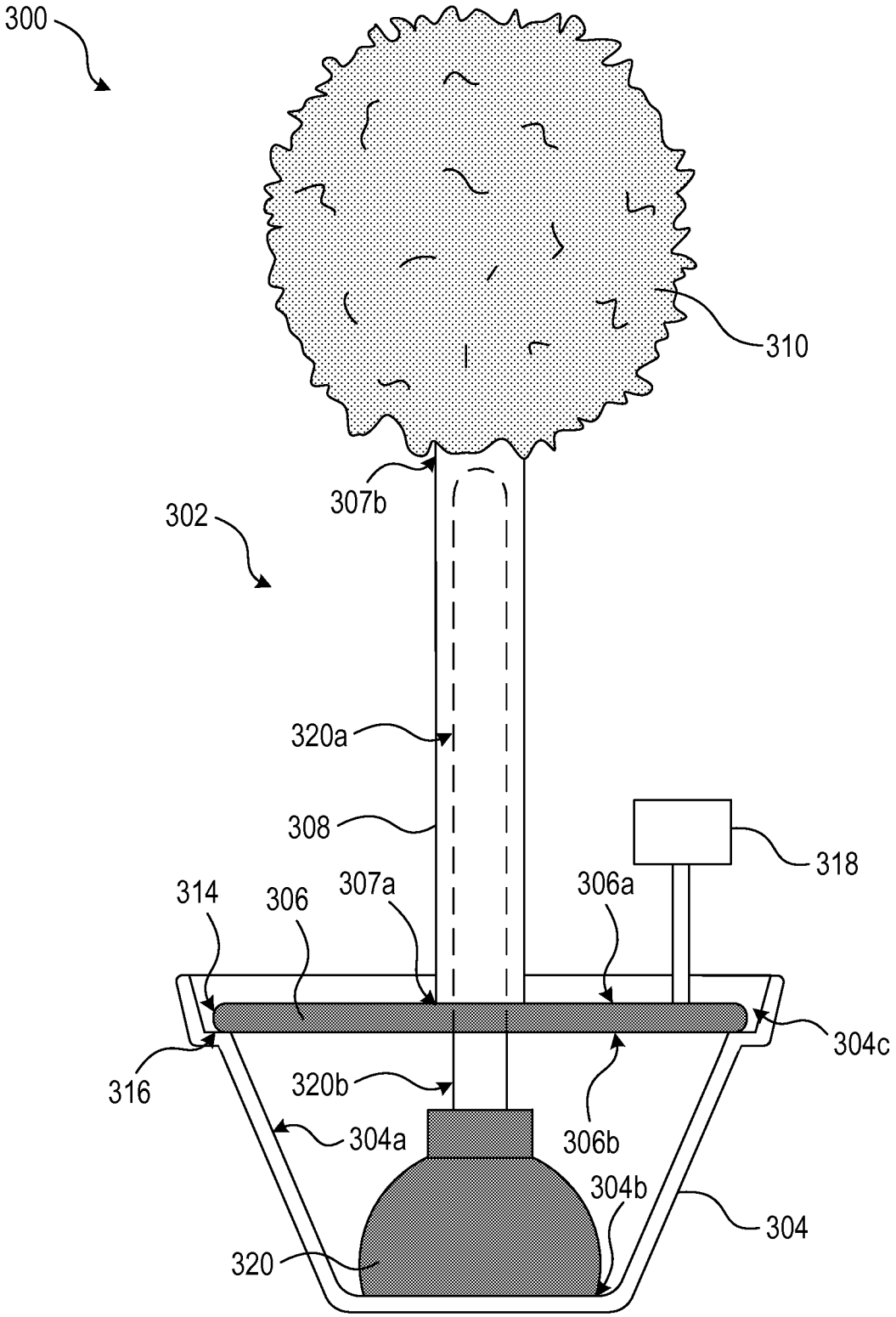
FIG. 3 illustrates a cross sectional view of an ornamental device in accordance with an implementation of the disclosure.

FIG. 3 illustrates a cross sectional view of an ornamental device 300 in accordance with an implementation of the disclosure. The ornamental device includes an ornamental cover 302 and a container 304. The ornamental cover 302 includes a base member 306 having an upper surface 306*a* and a lower surface 306*b*. An elongated shaft 308 having a proximal end 307*a* and a distal end 307*b* is connected at its proximal end 307*a* to the upper surface 306*a* of the base member 306 and extends distally from the upper surface 306*a*. The elongated shaft 308 may also include a decorative element 310 at the distal end 307*b*. In some implementations, the ornamental device 300 includes a handle 318 that extends from the upper surface 306*a* of the base member 306, which may be included if the elongated shaft 308 is difficult or cumbersome to grasp. The handle 318 may be in the form of a sign, a handled tool, or any other object that may be grasped by a human hand. In some implementations, the handle 318 may be in the form of a basket handle (e.g., a flower basket handle) that connects to two locations on the upper surface 306*a* of the base member 306.

The container 304 includes one or more sidewalls 304*a* (e.g., a single sidewall if the container 304 is round or oval-shaped, or multiple sidewalls if the container is a different shape) and a bottom interior surface 304*b*. In some implementations, the container may be cylindrical, be square, rectangular, shaped like a parallelogram, or may have any other suitable shape. In some implementations, the one or more sidewalls 304*a* define an opening 304*c* of the container 304. An article 320 (e.g., a plunger) may rest on the bottom interior surface 304*b* such that a lower portion 320*b* of the article 320 is housed within the container 304, while an upper portion 320*a* extends out through the opening 304*c* of the container 304.

The ornamental cover 302 may conceal the article 320 by at least partially fitting over the upper portion 320*a* of the article 320 (e.g., by receiving the upper portion 320*a* of the article 320 through the lower surface 306*b* of the base member 306 and into the elongated shaft 308. The base member 306 (e.g., a perimeter 314 of the base member 306) may be shaped to fit the opening 304*c* of the container 304. In some implementations, the container 304 may include a ledge portion 316 near the opening 304*c* on which the base member 306 may rest. In some implementations, the perimeter 314, a substantially vertical surface extending between the upper surface and the lower surface of the base member 306 as shown in the Figures, may include a fibrous texture (e.g. the same material which covers the upper surface of the base member, such as grass or leaves as referenced above and as shown in FIG. 1B at 106*a*), to encourage a frictional fit between the container 304 and the base member 306. In this manner, the frictional engagement will be tighter than with no fibrous material present and will facilitate holding the base member in place, but will not be so tight as could occur with a suctional fit between the base member and container where it would be difficult to separate the two. In some implementations, the base member 306 may include a coupling member that couples the base member to the container 304. For example, the coupling member may be a threaded perimeter that allows for the base member 306 to be screwed into the opening 304*c* of the container 304 (e.g., coupling to a complementary threaded region of the container 304). In some implementations, magnets may be disposed on the base member 306 and the container 304. In some implementations, a flexible liner (e.g., a plastic liner) may be disposed on the perimeter 314 of the base member 306 such that an air-tight seal may be formed between the base member 306 and the container 304. In some implementations, at portion of the perimeter 314 may be received into a slot located at an upper portion of the container 304. In some implementations, the base member 306 may include a detent that snaps into place when the perimeter 314 is received into the slot.

When the upper portion 320*a* of the article 320 is received into the ornamental cover 302, this helps serve to stabilize the ornamental cover 302 and prevent the ornamental cover 302 from being easily displaced from the container 304. Although the base member 306 is illustrated as a disc shape, other shapes may be utilized (e.g., square, rectangular, etc.). For example, the base member 306 may have a convex dome shape, which may increase the effective volume of the container. In some implementations, the elongated shaft 308 may be not receive an article (e.g., the article may be entirely contained within the container 304), and the elongated shaft 308 may be omitted entirely. In some implementations, if the ornamental cover 302 does not receive a portion of an article, the base member 306 may have its weight distributed to provide stability when placed over the opening 304*c* of the container 304.

Figure 4A:
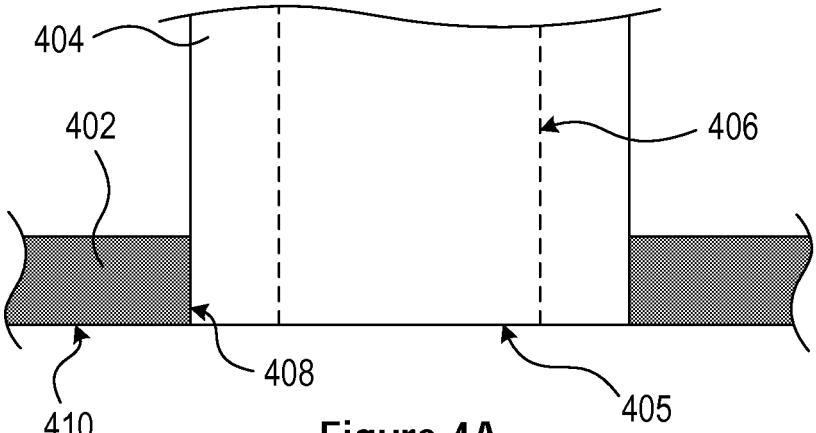
FIG. 4A illustrates a cross sectional view of an elongated shaft attached to a base member in accordance with an implementation of the disclosure.
Figure 4B:
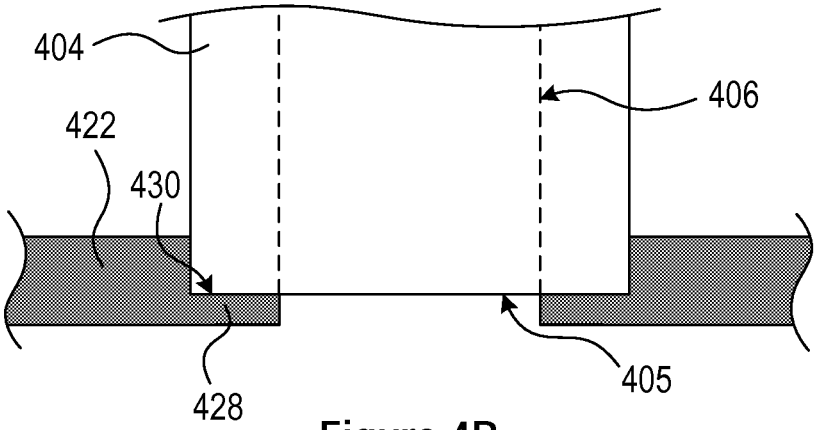
FIG. 4B illustrates a cross sectional view of an elongated shaft attached to a base member in accordance with another implementation of the disclosure.
Figure 4C:
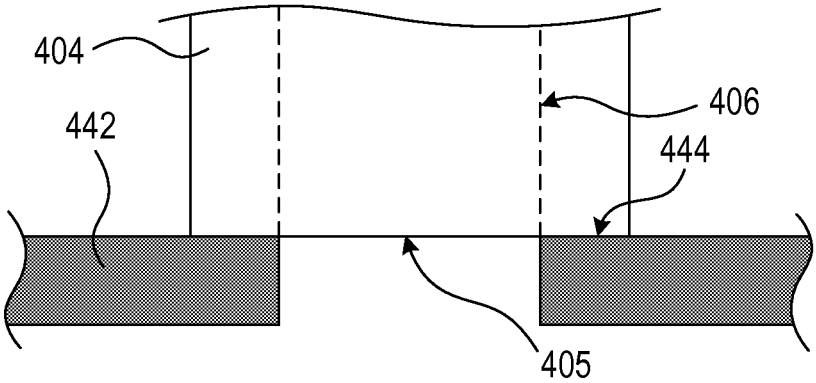
FIG. 4C illustrates a cross sectional view of an elongated shaft attached to a base member in accordance with yet another implementation of the disclosure.

FIGS. 4A-4C illustrate cross sectional views of an elongated shaft 404 attached to different base members 402, 422, 442 in accordance with certain implementations of the disclosure. The elongated shaft 404 includes an opening 405 defined by an inner perimeter 406. In FIG. 4A, the opening 405 is flush with a bottom surface 410 of the base member 402, and may be affixed to an inner surface 408 of the base member 402 (e.g., using an adhesive). In FIG. 4B, the base member 422 includes a ledge 428 to provide additional support to the elongated shaft 404. In some implementations, the elongated shaft 404 may be affixed to the ledge surface 430. In FIG. 4C, the elongated shaft 404 is affixed to a top surface 444 of the base member 442.

FIG. 5A illustrates a cross sectional view of an ornamental device 500 utilizing a dowel 514 to secure an ornamental cover 502 in accordance with an implementation of the disclosure. The dowel 514 may be a removable dowel that can be coupled to a coupling portion 518 of a container 504. For example, as illustrated, the dowel may include a threaded portion 516 that can screw into the coupling portion 518. A portion of the dowel may be received through an opening 512 of a base member 506 of the ornamental cover 502 and into an elongated shaft 508 of the ornamental cover 502. The dowel 514 may be used for stabilizing the ornamental cover 502 when the ornamental device does not contain an article that extends out of the container 504. The dowel 514 may be removed when an article that is capable of being received into the ornamental cover 502 is placed in the container 504. In the example shown in FIG. 5A, the perimeter 506*a* of the base member 506 does not include a fibrous texture.

Figure 5B:
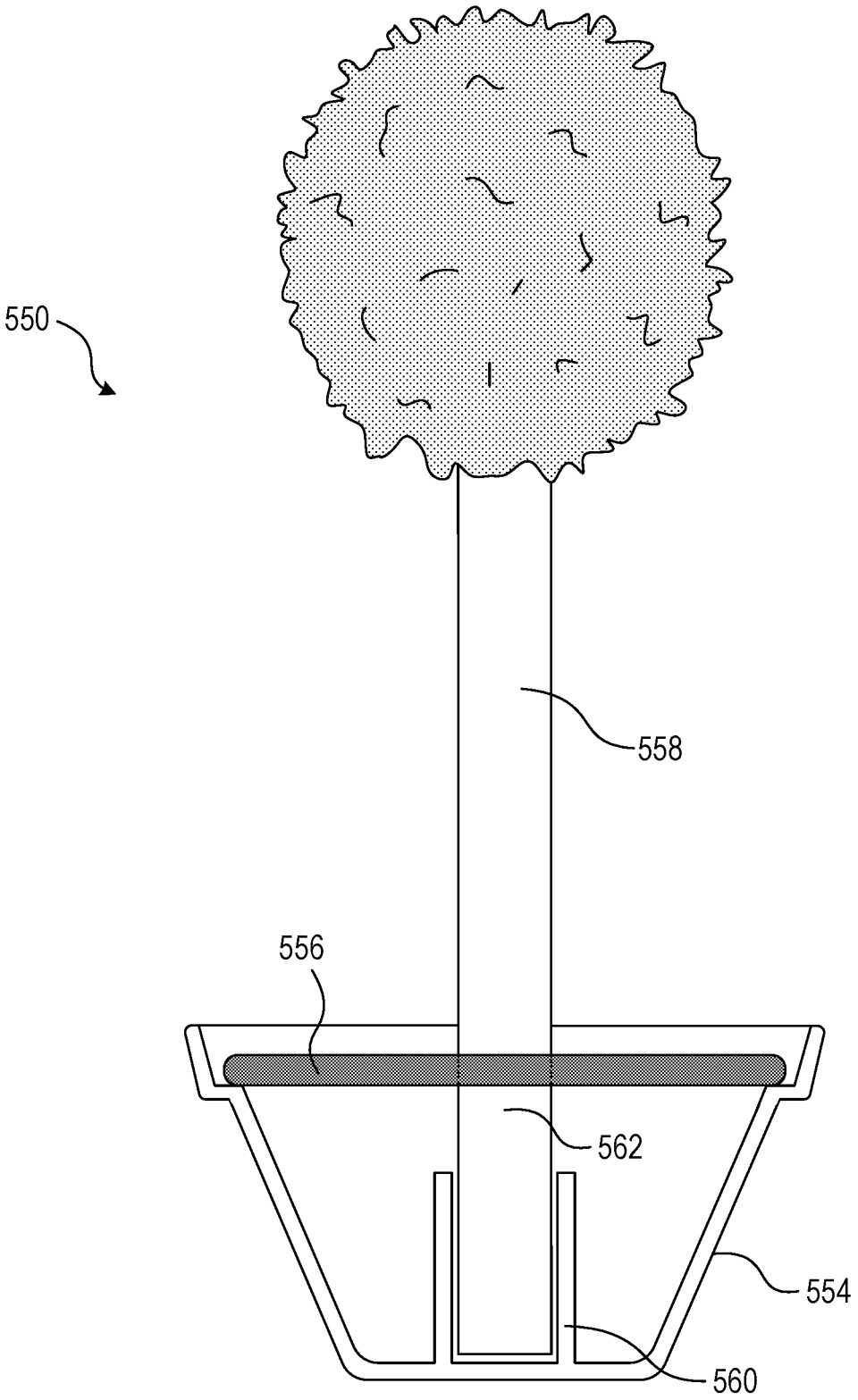
FIG. 5B illustrates a cross sectional view of an ornamental cover including a protruding dowel in accordance with an implementation of the disclosure.

FIG. 5B illustrates a cross sectional view of an ornamental cover 550 including a protruding dowel 562 in accordance with an implementation of the disclosure. In some implementations, the dowel 562 may be sized to fit within and/or removably couple to an elongated shaft or base member 556 of the ornamental cover 550. In some implementations, the dowel 562 may be an extension of the elongated shaft 558, and a position of the base member 556 along the elongated shaft 558 may be adjustable. The dowel 562 may be received into a receiving slot 560 within a container 554 to stabilize the ornamental cover 550. In some implementations, the receiving slot 560 is affixed to or integrally formed from a bottom interior surface of the container 554. In some implementations, the receiving slot is a separate and/or removable component.

Figure 6:
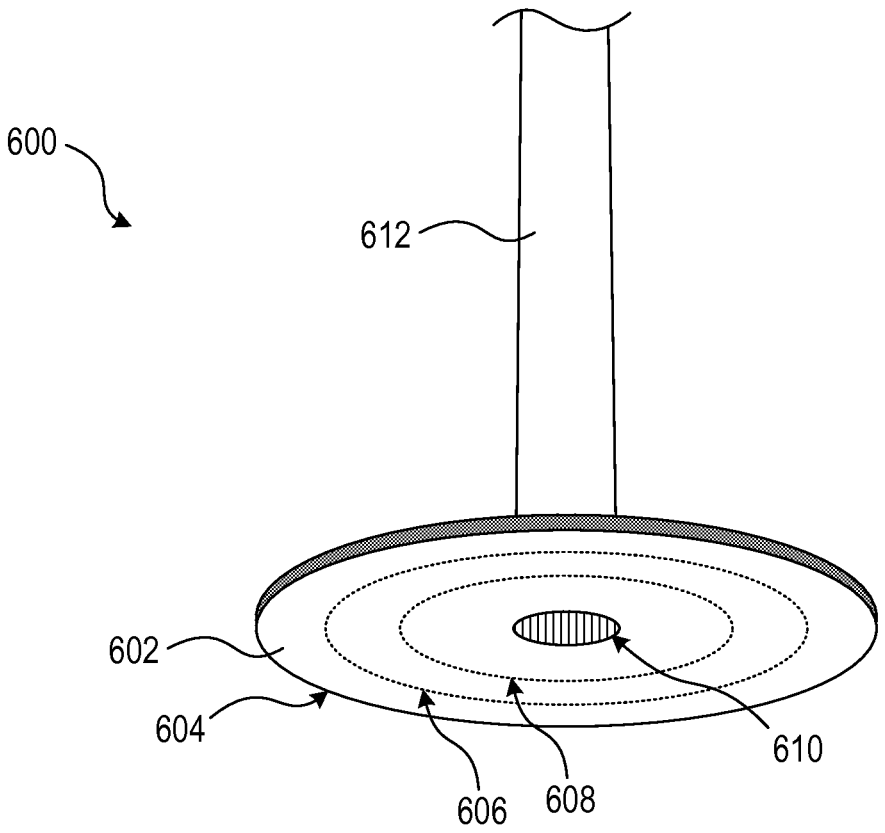
FIG. 6 illustrates an ornamental cover having a resizable base member in accordance with an implementation of the disclosure.

FIG. 6 illustrates a cross sectional view of an ornamental cover 600 having a resizable base member 602 in accordance with an implementation of the disclosure. The base member 602 may be attached to an elongated shaft 612 and define an opening 610 into the elongated shaft 612 in accordance with any of the implementations described herein. In some implementations, the base member 602 may include one or more junctions 606, 608 (e.g., perforated junctions), which can allow for removal of portions of the base member 602 to provide a better fit of the ornamental cover 600 to a container. For example, the base member may be pre-fabricated to have an initial outer perimeter 604 and a first perforated junction 606 and a second perforated junction 608. A portion of the base member 602 may be trimmed at the first perforated junction 606 to define a new outer perimeter of the base member 602. In some implementations, the base member may be reversibly adjustable (e.g., the base member 602 may have a telescoping structure).

Figure 7:
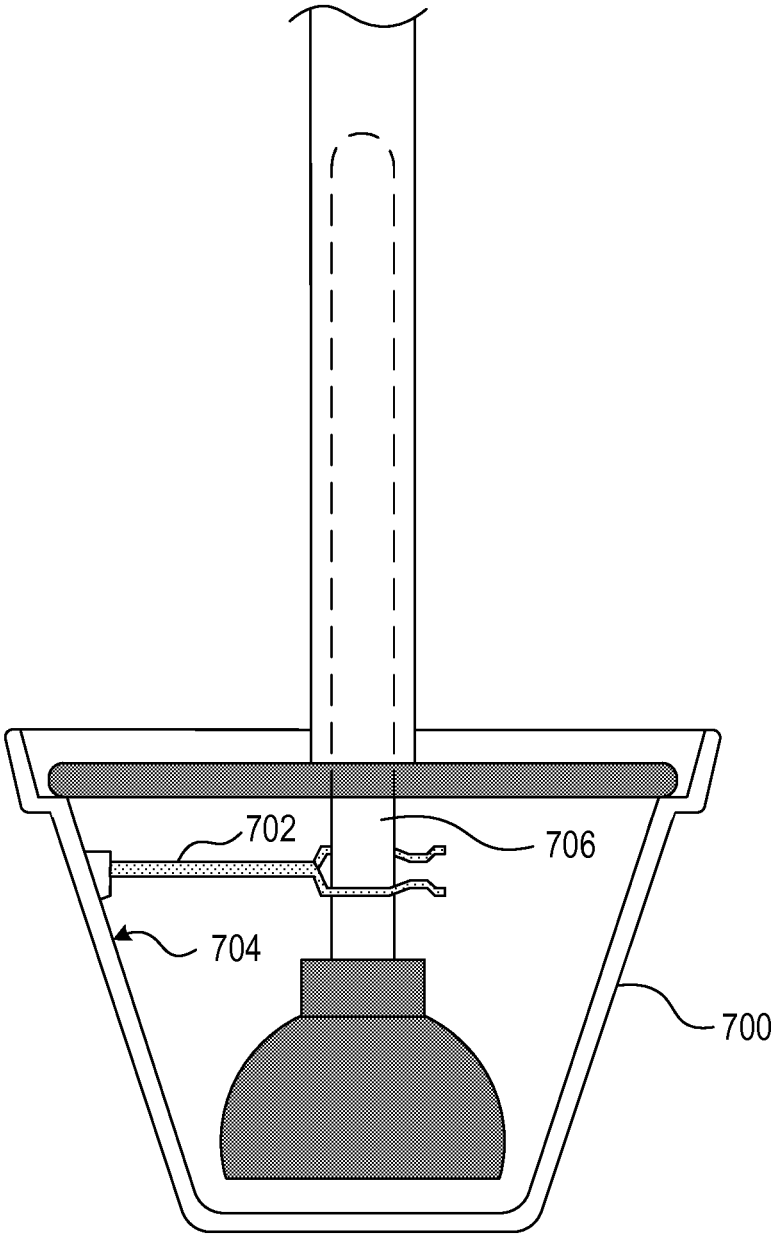
FIG. 7 illustrates a cross sectional view of a container that includes a clamp for securing an article in accordance with an implementation of the disclosure.

FIG. 7 illustrates a cross sectional view of a container 700 that includes a clamp 702 for securing an article 706 in accordance with an implementation of the disclosure. In some implementations, the clamp 702 may extend from an interior sidewall 704 of the container 700. In some implementations, additional clamps may be utilized.

Figure 8:
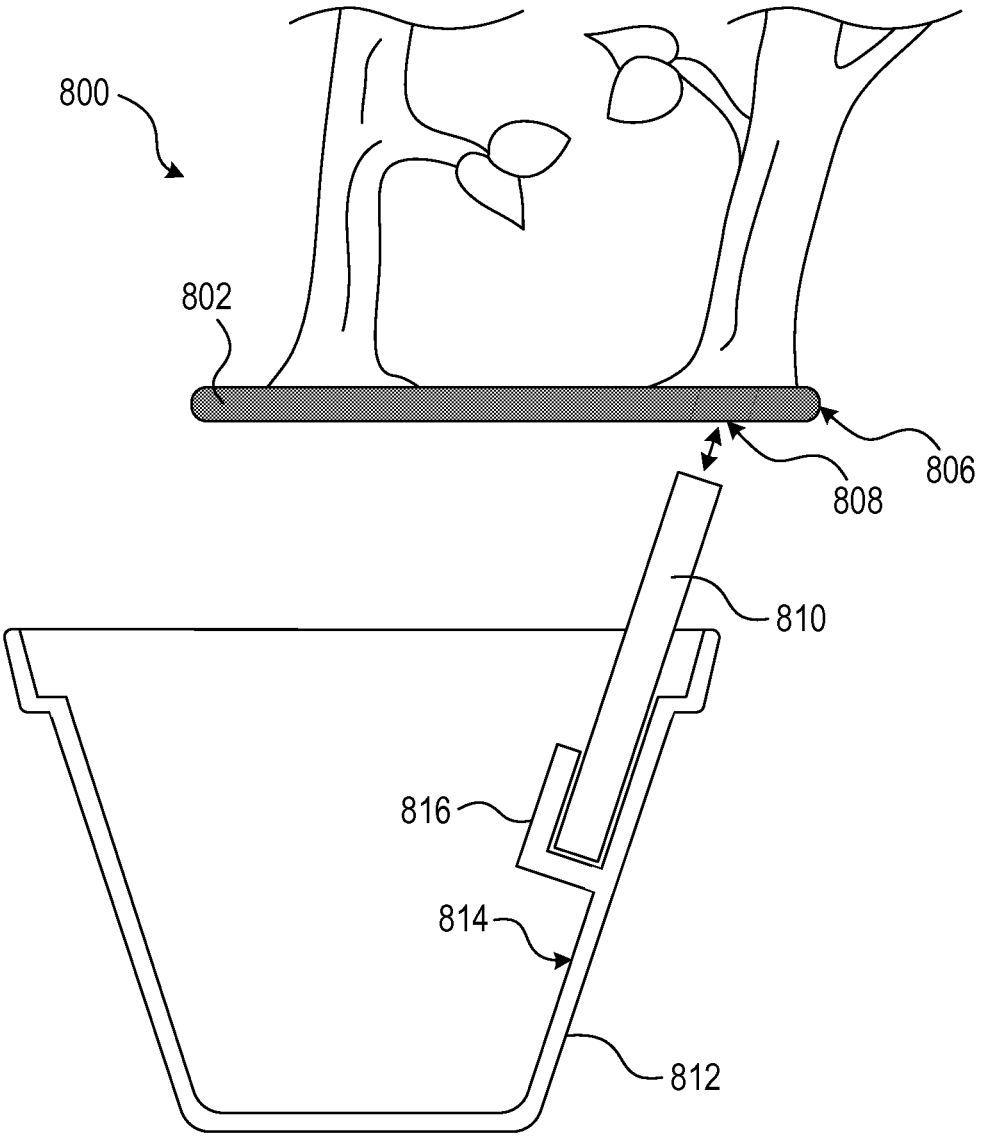
FIG. 8 illustrates a cross sectional view of a pivotable ornamental cover in accordance with an implementation of the disclosure.

FIG. 8 illustrates a cross sectional view of a pivotable ornamental cover 800 in accordance with an implementation of the disclosure. A base member 802 of the ornamental cover 800 may define an opening 808 near a perimeter 806 of the base member 802. The opening 808 may receive an article 810 (e.g., a dowel, a tool, etc.) when the article 810 is secured to or near a sidewall 814 of a container 812. In some implementations, the article 810 may be received into a receiving slot 816 within the container 812. In such implementations, the ornamental cover 800 may be lifted and rotated to provide access to an interior portion of the container 812 without removing the ornamental cover 800 entirely.

Figure 9:
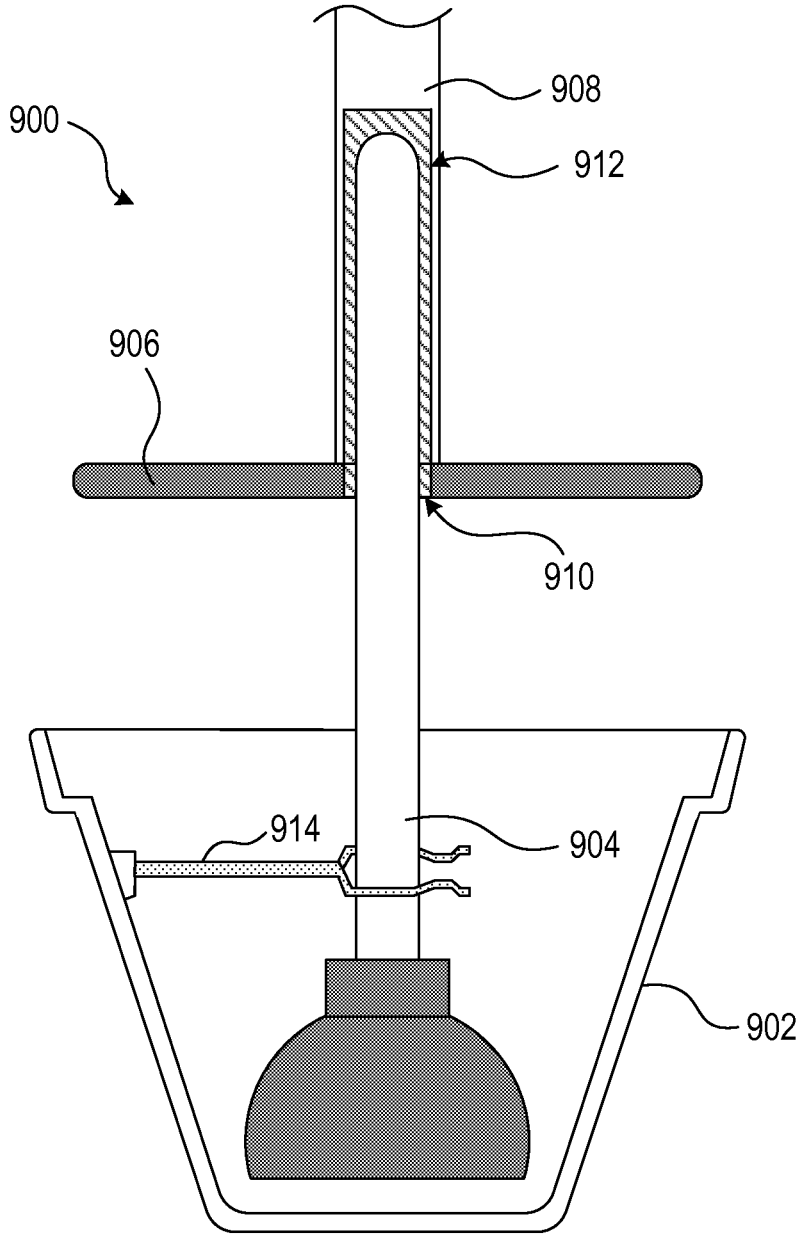
FIG. 9 illustrates a cross sectional view of a slidable ornamental cover in accordance with an implementation of the disclosure.

FIG. 9 illustrates a cross sectional view of slidable ornamental cover 900 in accordance with an implementation of the disclosure. The ornamental cover 900 includes a base member 906 and an elongated shaft 908 for concealing an article 904 that is inside of a container 902. A cutaway portion 910 of the base member 906 and a cutaway portion 912 of the elongated shaft 908 allows for the ornamental cover 900 to slide over the article 904. The cutaway portions 910 and 912 may be sized depending on the article 904 that is to be covered. In some implementations, the container 902 may include a clamp 914 that secures the article 904. In some implementations, at portion of the base member 906 may be received into a slot located at an upper portion of the container 902. In some implementations, the base member 906 may include a detent that snaps into place when the base member 906 is received into the slot.

Figure 10:
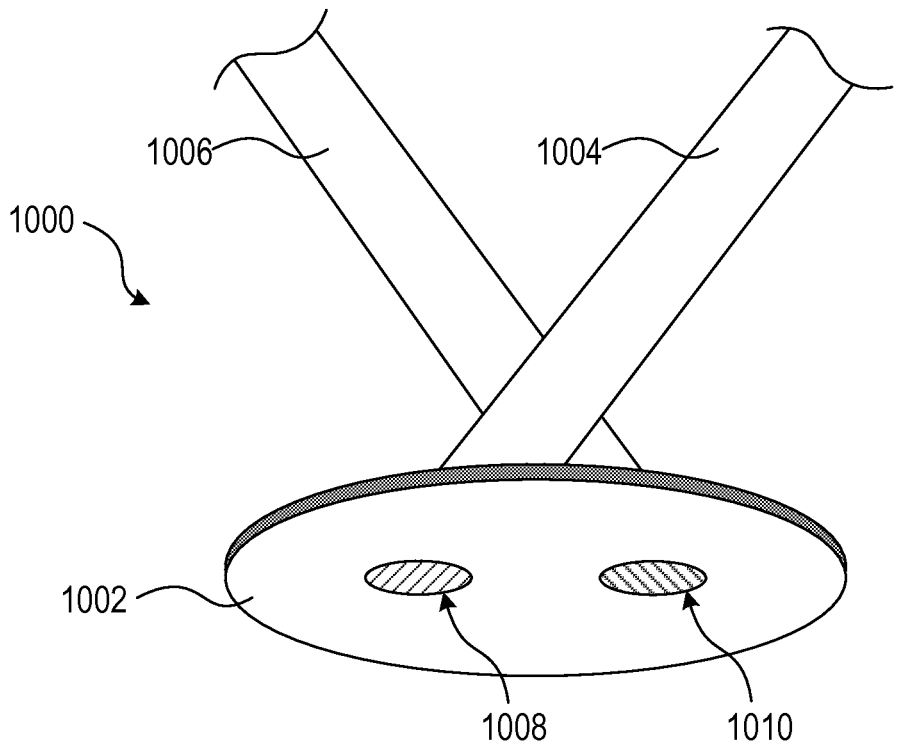
FIG. 10 illustrates an ornamental cover that includes two elongated shafts in accordance with an implementation of the disclosure.

FIG. 10 illustrates an ornamental cover 1000 that includes two elongated shafts 1004, 1006 extending from a base member 1002 in accordance with an implementation of the disclosure. Each of elongated shafts 1004, 1006 are capable of receiving articles through openings 1008, 1010, respectively, with the articles being storable in a suitably sized container. In some implementations, the ornamental cover 1000 may include additional elongated shafts.

Figure 11:
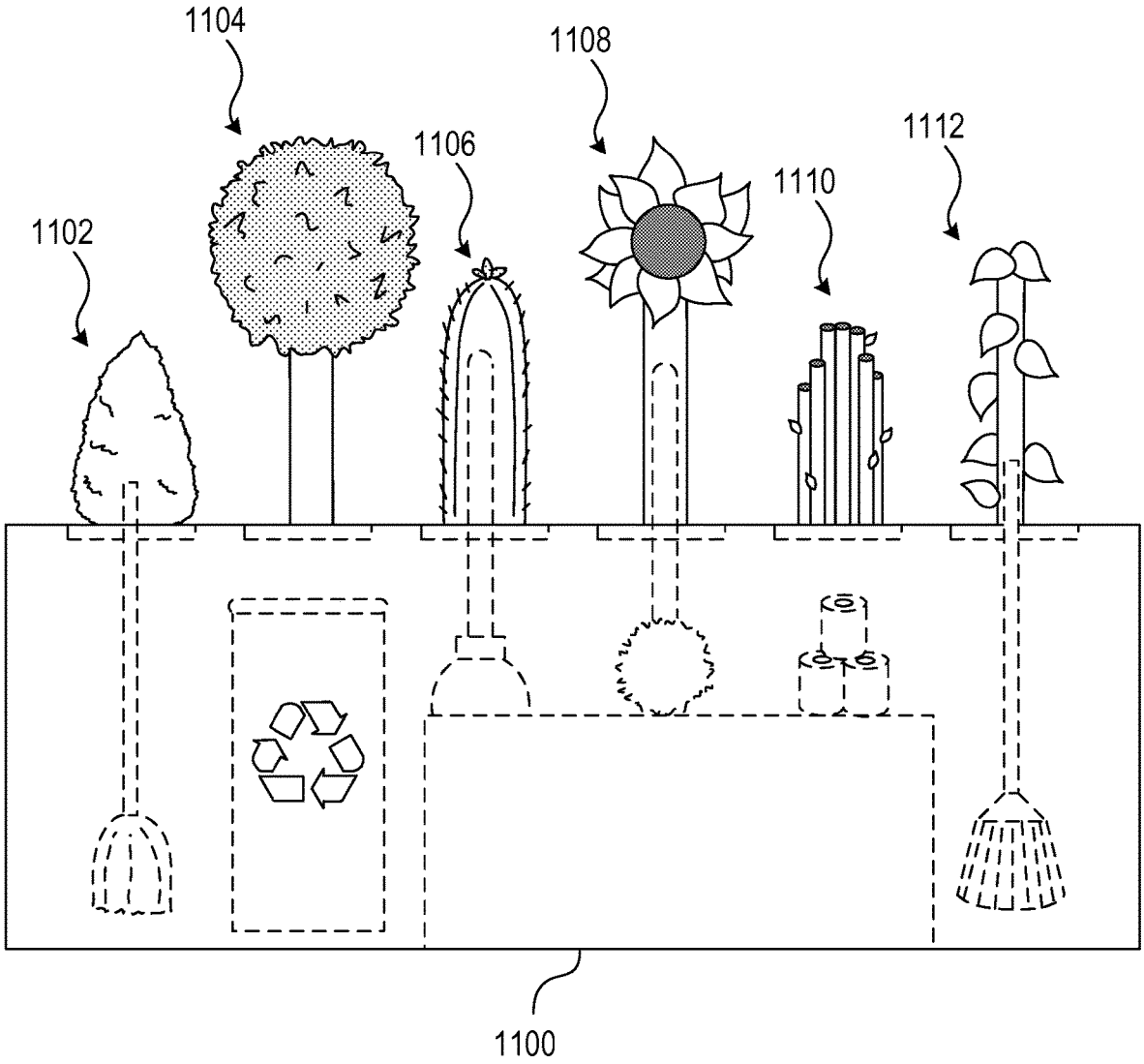
FIG. 11 illustrates a cross sectional view of a container having multiple ornamental covers in accordance with an implementation of the disclosure

FIG. 11 illustrates a container 1100 having multiple ornamental covers 1102, 1104, 1106, 1108, 1110, 1112 in accordance with an implementation of the disclosure. Each of ornamental covers 1102, 1104, 1106, 1108, 1110, 1112 may be appropriately sized and shaped to conceal different types of articles and fit various openings of the container 1100 in accordance with any of the implementations described herein.

Figure 12:
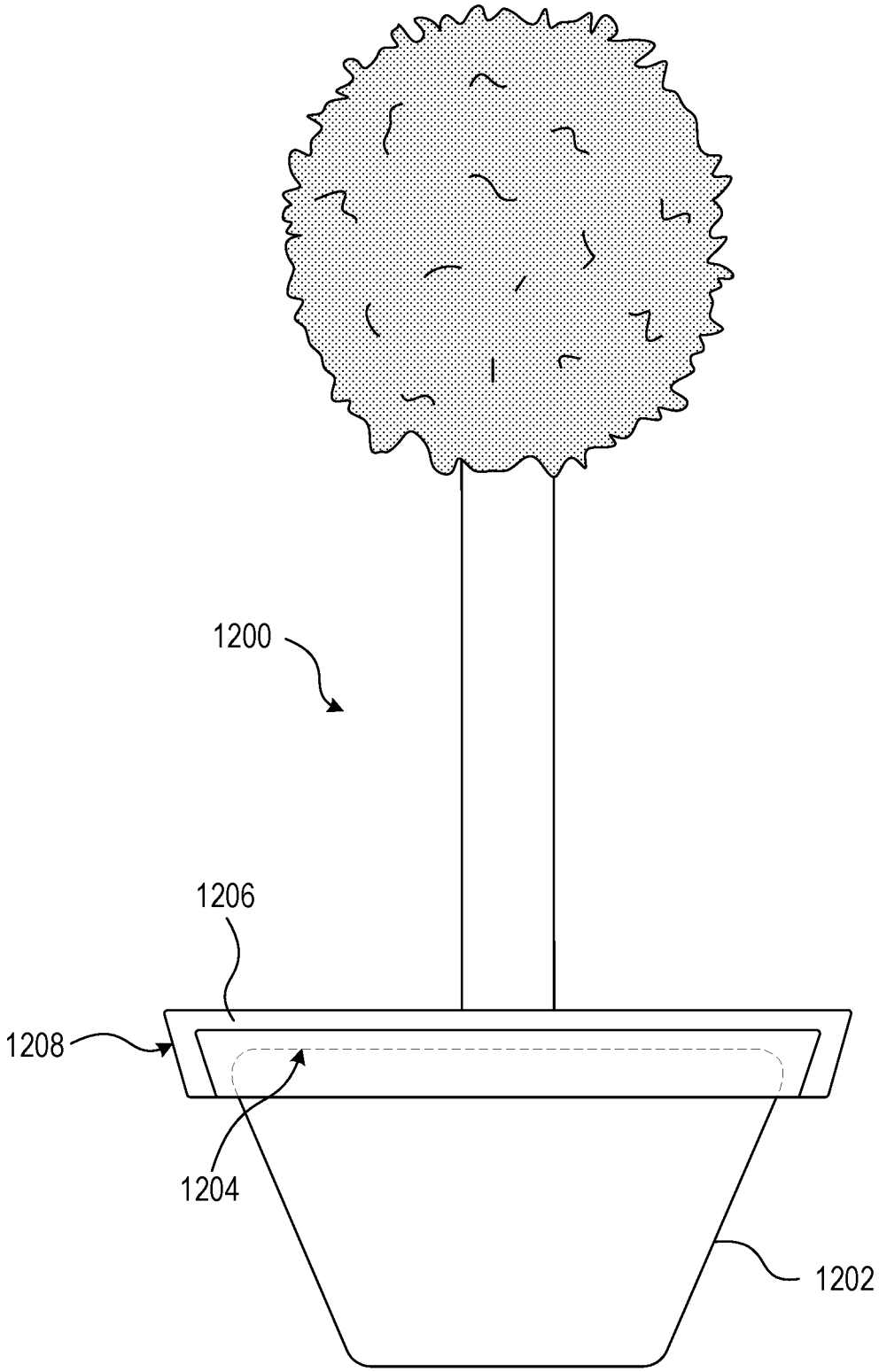
FIG. 12 illustrates a cross sectional view of an ornamental cover that fits over an upper portion of a container in accordance with an implementation of the disclosure.

FIG. 12 illustrates a cross sectional view of an ornamental cover 1200 that fits over a top portion 1204 of a container 1202 in accordance with an implementation of the disclosure. The ornamental cover 1200 includes a base member 1206 having a perimeter portion 1208 (e.g., a brim) that extends over the top portion 1204 of the container 1202 to stabilize the ornamental cover 1200 with respect to the container 1202.

Figure 13:
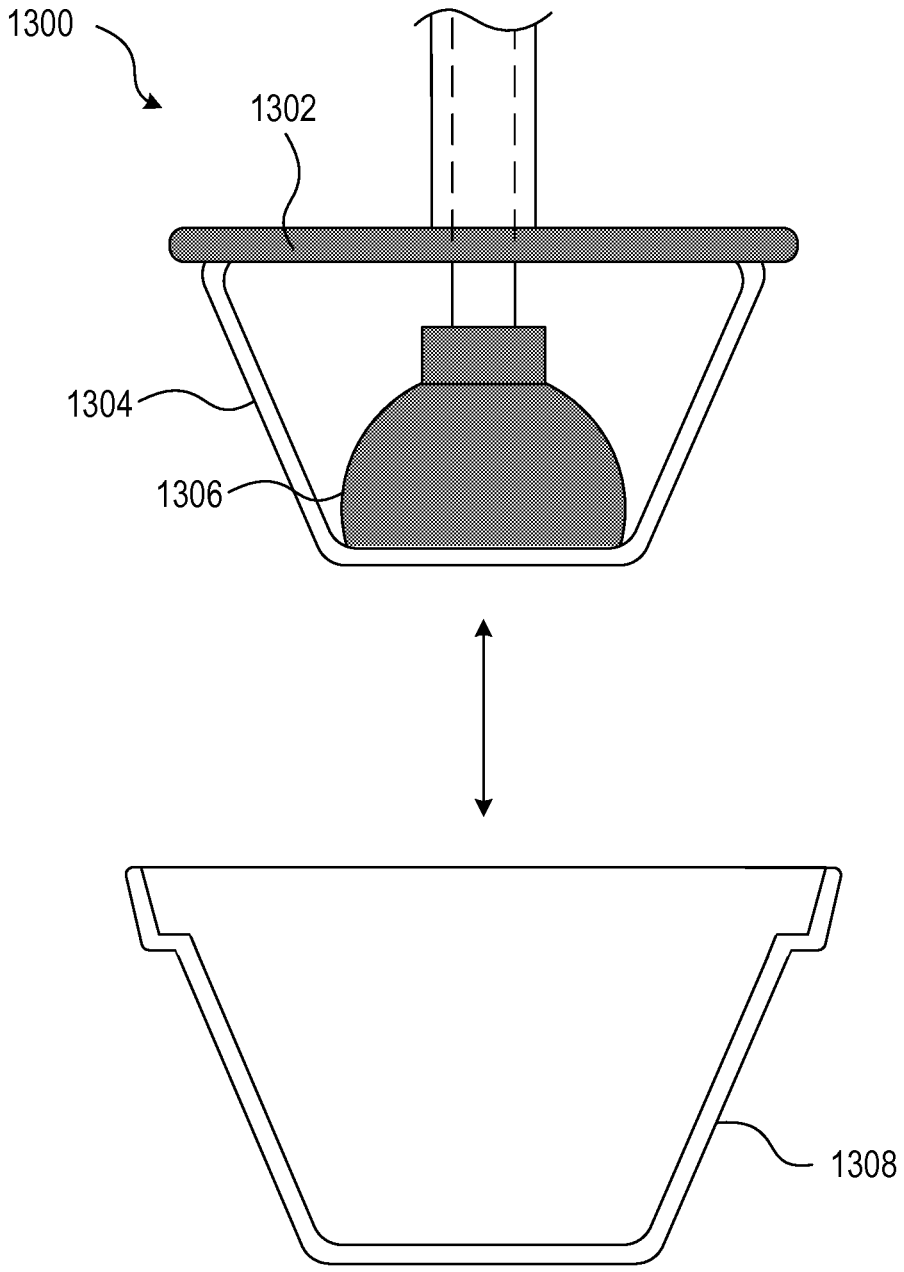
FIG. 13 illustrates an ornamental cover that includes a container in accordance with an implementation of the disclosure.

FIG. 13 illustrates an ornamental cover 1300 that includes a container 1304 in accordance with an implementation of the disclosure. A base member 1302 of the ornamental cover 1300 may be couple directly to the container 1304 after an article 1306 has been placed inside of the container 1304. The ornamental cover 1300 may then be placed into a second container 1308 (e.g., a ceramic pot) to further conceal the article 1306.

Figure 14:
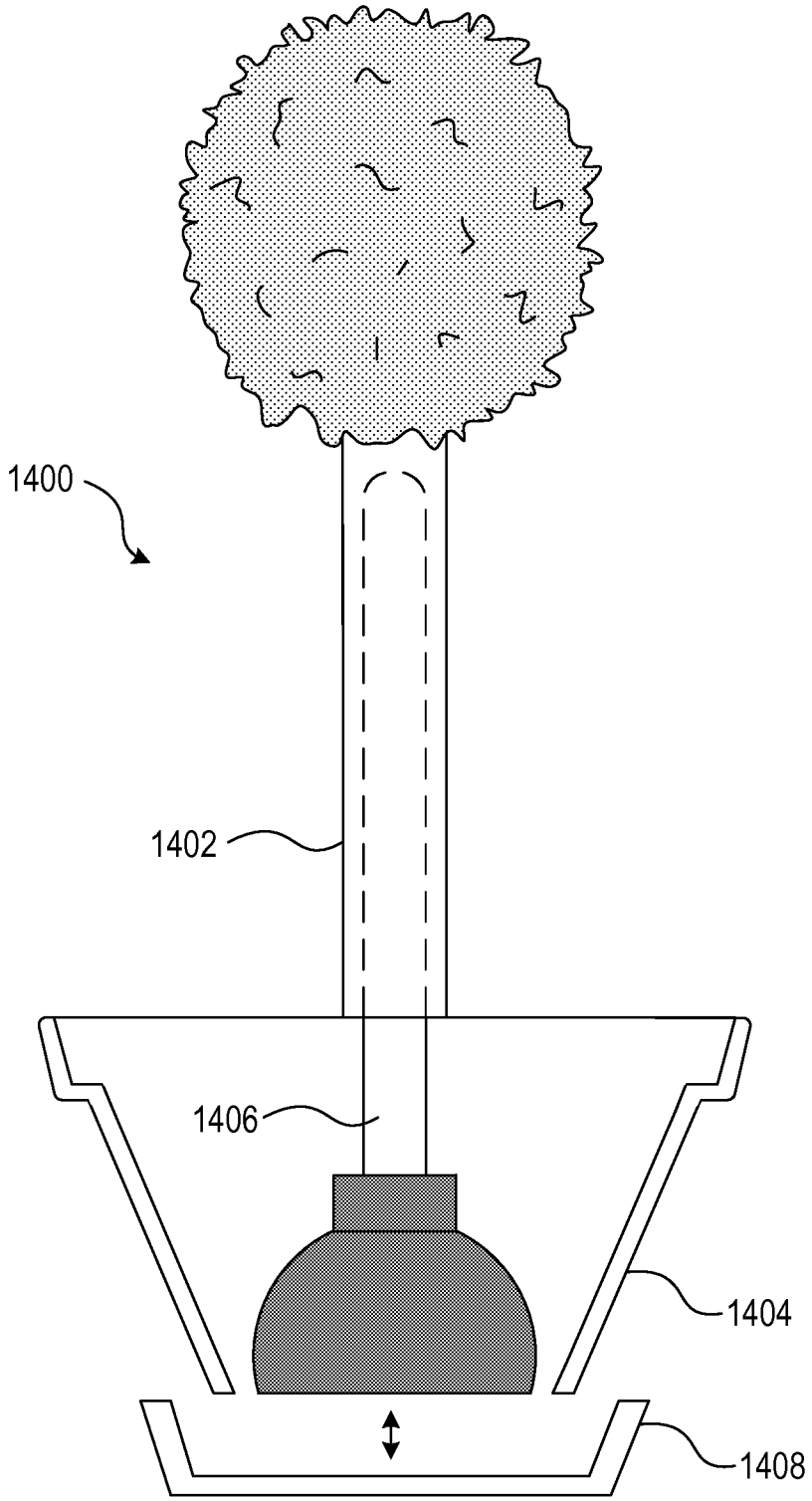
FIG. 14 illustrates an ornamental cover utilizing a container as a base member in accordance with an implementation of the disclosure.

FIG. 14 illustrates an ornamental cover 1400 utilizing a container 1404 as a base member in accordance with an implementation of the disclosure. The ornamental cover 1400 includes an elongated shaft 1402 that is affixed to the container 1404. A bottom portion of the container 1404 may define an opening such that ornamental cover 1400 may fit over and conceal an article 1406. In some implementations, a separate base 1408 may enclose the article 1406 within the ornamental cover 1400. For example, if the article 1406 is a broom, the base 1408 may be a dust pan for use with the broom.

Figure 15:
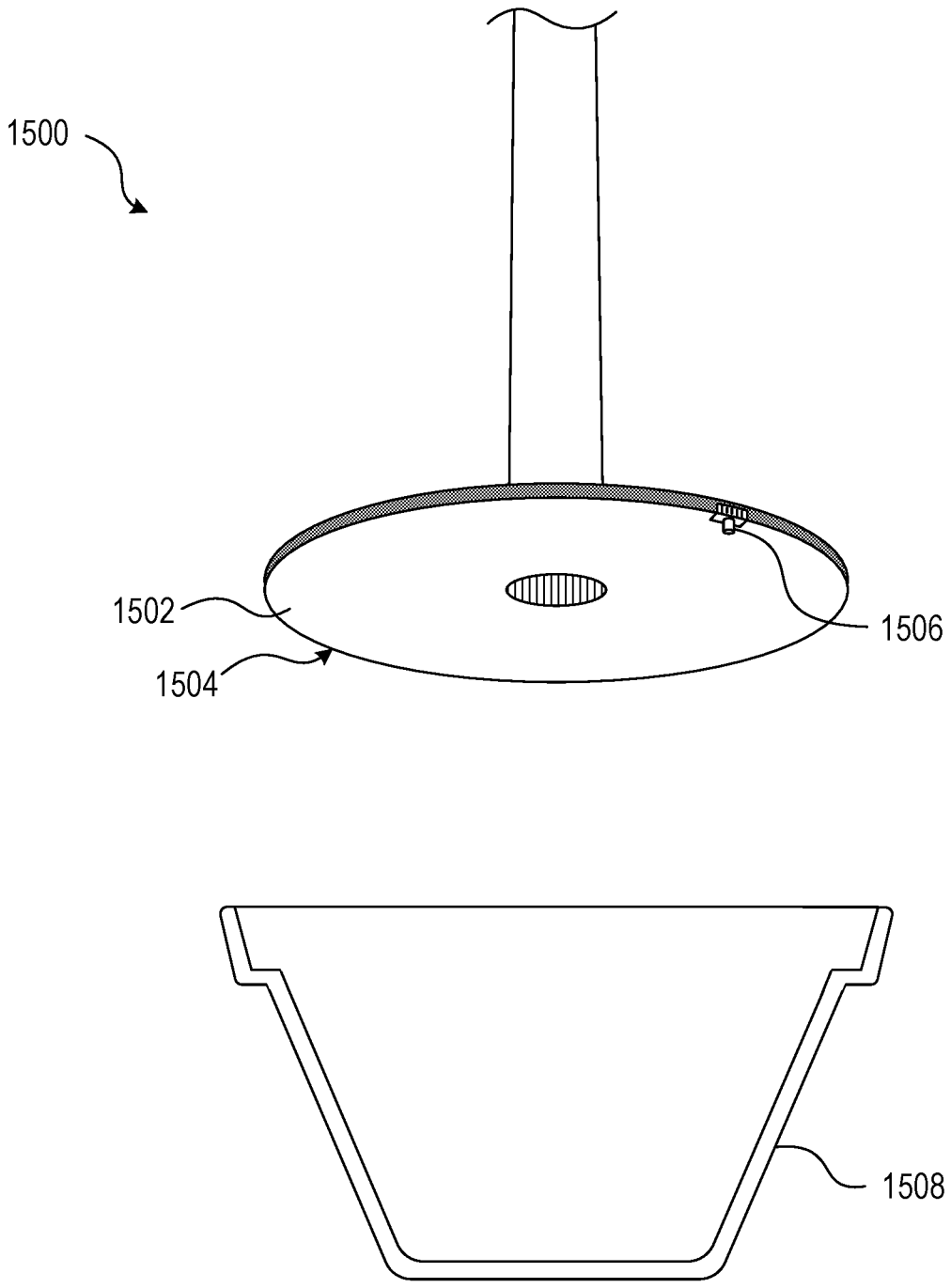
FIG. 15 illustrates an ornamental cover having an actuatable button in accordance with an implementation of the disclosure.

FIG. 15 illustrates an ornamental cover 1500 having an actuatable button 1506 in accordance with an implementation of the disclosure. The actuatable button 1506 may be located at or near a perimeter 1504 of a base member 1502 of the ornamental cover 1500. In some implementations, when the ornamental cover 1500 is placed over and in contact with a container 1508, the actuatable button 1506 may be depressed and inactivated. When the ornamental cover 1500 is subsequently separated from the container 1508, the actuatable button 1506 extends and is activated. In some implementations, activation of the actuatable button 1506 may cause an electronic device to generate a visual signal (e.g., activation of lights) and/or audio signal (e.g., a voice clip or music) when activated. In some implementations, the electronic device is located on or in the base member 1502 and is communicatively coupled to the actuatable button 1506. In some implementations, the electronic device is separate from the base member (e.g., a Bluetooth device that is in communication with a transceiver coupled to the actuatable button 1506. In some implementations, other types of devices may be used to generate an audio or visual signal. For example, a light sensor may be activated upon detecting ambient light when the ornamental cover 1500 is removed from the container 1508. In some implementations, the actuatable button 1506 may be connected to an air freshener device that disperses an aromatic fluid when the ornamental cover is placed on or removed from the container 1508.

Figure 16A:
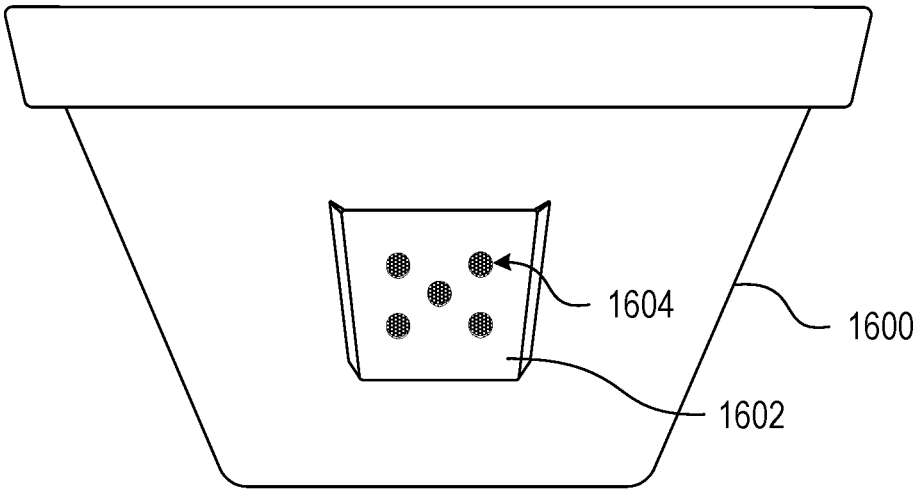
FIG. 16A illustrates a front view of a container having a receptacle for housing an aromatic medium in accordance with an implementation of the disclosure.
Figure 16B:
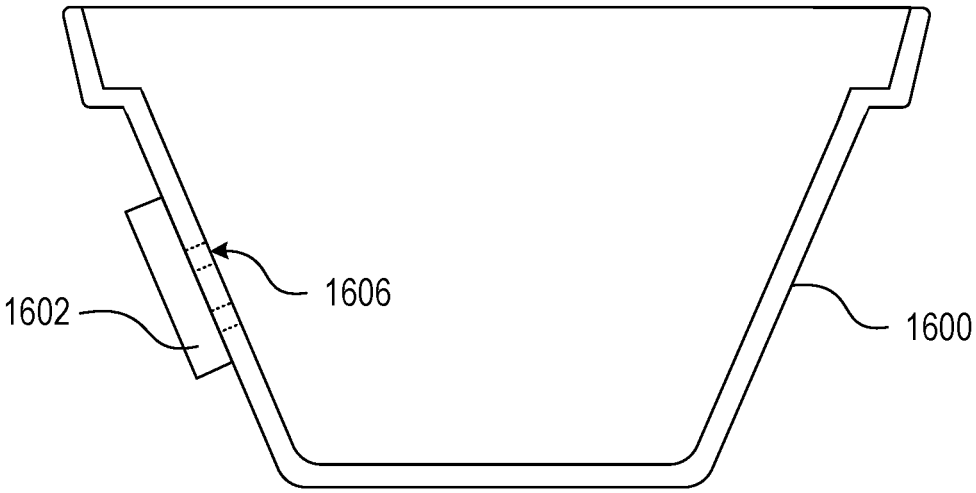
FIG. 16B illustrates a cross-sectional side view of a container having receptacle for housing an aromatic medium in accordance with an implementation of the disclosure.

FIGS. 16A and 16B illustrate a front view and a cross-sectional side view, respectively, of a container 1600 having receptacle 1602 for housing an aromatic medium (e.g., a gel pad, a potpourri packet, etc.) in accordance with an implementation of the disclosure. The receptacle may include one or more openings 1604, and the container 1600 may also include one or more openings 1606 at the location of the receptacle 1602 such that an air-flow pathway is defined through the receptacle 1602 and into the container 1600.

When an ornamental cover is placed on top of the container 1600, as described herein in accordance with various implementations, air may be forced through the one or more openings 1606 to force air through the aromatic medium. In some implementations, an ornamental cover having a dome-shaped, flexible base member, which may serve to increase the air pressure within the container 1600 and force more air through the aromatic medium upon placing the ornamental cover onto the container 1600.

Figure 17:
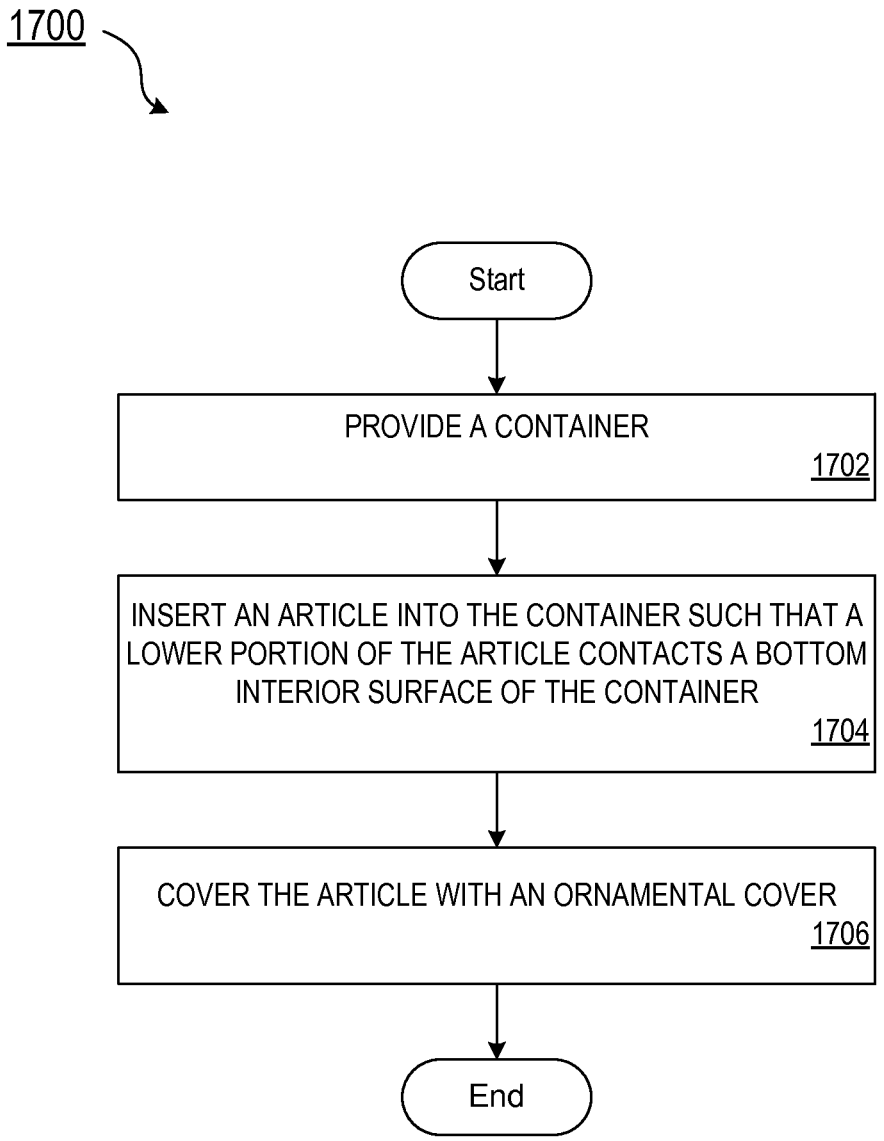
FIG. 17 is a block diagram illustrating a method for concealing a tool using an ornamental device in accordance with an implementation of the disclosure.

FIG. 17 is a block diagram illustrating a method 1700 for concealing a tool using an ornamental device in accordance with an implementation of the disclosure. At block 1702, a container is provided. The container may be any container as described herein. At block 1704, an article is inserted into the container such that a lower portion of the article contacts a bottom interior surface of the container. In some implementations, an upper portion of the article extends out through an opening of the container. In some implementations, the article is a handled tool (e.g., a plunger, a toilet brush, a shovel, a mop, a broom, etc.), and the upper portion of the article may correspond to the handle of the tool. At block 1706, the article is covered with an ornamental cover. In some implementations, the article is covered such that the upper portion of the article is received through a base member of the ornamental cover and into an elongated shaft of the ornamental cover. In some implementations, the base member is sized to fit the opening of the container. The ornamental cover may be any ornamental cover as described herein.

For simplicity of explanation, the implementations of the method of this disclosure are depicted and described as a series of acts. However, acts in accordance with this disclosure can occur in various orders and/or concurrently, and with other acts not presented and described herein. Furthermore, not all illustrated acts may be required to implement the methods in accordance with the disclosed subject matter.

In the foregoing description, numerous details are set forth. It will be apparent, however, to one of ordinary skill in the art having the benefit of this disclosure, that the present disclosure may be practiced without these specific details.

The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form. Reference throughout this specification to "an implementation" or "one implementation" means that a particular feature, structure, or characteristic described in connection with the implementation is included in at least one implementation. Thus, the appearances of the phrase "an implementation" or "one implementation" in various places throughout this specification are not necessarily all referring to the same implementation. Moreover, it is noted that the "A-Z" notation used in reference to certain elements of the drawings is not intended to be limiting to a particular number of elements. Thus, "A-Z" is to be construed as having one or more of the element present in a particular implementation.

It is to be understood that the above description is intended to be illustrative, and not restrictive. Many other implementations will be apparent to those of skill in the art upon reading and understanding the above description. The scope of the disclosure should, therefore, be determined with reference to the appended claims, along with the full scope of equivalents to which such claims are entitled.

What is claimed is:

1. A method, comprising:

providing an ornamental assembly comprising a container and an ornamental cover;

inserting an article into the container such that the lower portion of the article contacts a bottom interior surface of the container and an upper portion of the article extends out through an opening of the container; wherein:

said container defines an interior volume and an opening;

said ornamental cover comprises an elongated shaft having a proximal end and a distal end, and a base member disposed at the proximal end of the elongated shaft, the base member comprising an upper surface, a lower surface, and a perimeter comprising a substantially vertical surface extending between the upper surface and the lower surface, the perimeter including a fibrous texture configured to encourage a tighter fit between the container and the base member;

the base member simulates an appearance selected from the group consisting of potting soil, grass, leaves, and rocks;

the ornamental cover simulates the appearance of the elongated shaft being planted within the container;

a periphery of the base member is configured to fit within said opening, and the interior volume is unchanged because the elongated shaft does not intrude into the interior volume.

2. The method of claim 1, wherein the fibrous texture comprises a plant material, grass, or leaves.

3. The method of claim 1, wherein the fibrous texture comprises an artificial plant material, artificial grass, or artificial leaves.

4. An ornamental assembly comprising:

a container; and an ornamental cover;

said container defines an interior volume and an opening;

said ornamental cover comprises an elongated shaft having a proximal end and a distal end, and a base member disposed at the proximal end of the elongated shaft, the base member comprising an upper surface, a lower surface, and a perimeter comprising a substantially vertical surface extending between the upper surface and the lower surface, the perimeter including a fibrous texture configured to encourage a tighter fit between the container and the base member; wherein:

the ornamental cover simulates the appearance of the elongated shaft being planted within the container, the elongated shaft extends outwardly from the upper surface of the base member, the base member comprises an appearance selected from the group consisting of soil, grass, leaves, and rocks;

the lower surface of the base member is formed to include an opening formed therethrough for receiving the upper portion of an article into the elongated shaft, wherein the opening and the elongated shaft are shaped to freely receive and conceal the upper portion of an article without mechanically coupling to the article, the opening formed through the base member defines an inner surface, the elongated shaft is affixed to the inner surface;

the proximal end of the elongated shaft does not extend beyond the lower surface of the base member, and a periphery of the base member is configured to fit within said opening and the interior volume is unchanged because the elongated shaft does not intrude into the interior volume.

5. The said ornamental cover of claim 4, wherein the periphery of said base member encloses and conceals items placed within the container.

6. The ornamental cover of claim 4, further comprising:

at least one decorative element attached to the first elongated shaft.

7. The ornamental cover of claim 6, wherein the decorative element comprises one or more of a plant, an artificial plant, a light source, an air freshener, a sign, a mailbox, a bird house, a basketball hoop, a statue, a figurine of an animal, a figurine of a human, a teepee, a bird perch, a fence post, a log, a chalk board, a dry erase board, a cork board, a message board, a rocket, a spaceship, a space shuttle, a flag pole, a tether ball pole, an oil rig, a surfboard, a golf club, a golf caddy, a newspaper box, a telephone pole, a stadium, stadium lights, a stop light, a clothesline, a satellite dish, an antenna, a diving board, a lifeguard chair, a field goal post, a baseball bat, a hockey stick, a sword, a pool cue, a ski pole, an umbrella, a bowling pin, a candy cane, a fire extinguisher, a guitar, or a building.

8. The ornamental cover of claim 4, wherein the first opening comprises a ledge formed therein, the ledge comprising a ledge surface to which the proximal end of the first elongated shaft is affixed.

9. The ornamental cover of claim 4, wherein the fibrous texture comprises a plant material, grass, or leaves.

10. The ornamental cover of claim 4, wherein the fibrous texture comprises an artificial plant material, artificial grass, or artificial leaves.

11. A method, comprising:

providing an ornamental assembly comprising a container and an ornamental cover;

inserting an article into the container such that the lower portion of the article contacts a bottom interior surface of the container and an upper portion of the article extends out through an opening of the container; wherein:

said container defines an interior volume and an opening;

said ornamental cover comprises an elongated shaft having a proximal end and a distal end, and a base member disposed at the proximal end of the elongated shaft, the base member comprising an upper surface, a lower surface, and a perimeter comprising a substantially vertical surface extending between the upper surface and the lower surface, the perimeter including a means for encouraging a tighter fit between the container and the base member;

the base member simulates an appearance selected from the group consisting of potting soil, grass, leaves, and rocks;

the ornamental cover simulates the appearance of the elongated shaft being planted within the container;

a periphery of the base member is configured to fit within said opening, and the interior volume is unchanged because the elongated shaft does not intrude into the interior volume.

12. The method of claim 11, wherein the means for encouraging a tighter fit between the container and the base member comprises a plant material.

13. The method of claim 11, wherein the means for encouraging a tighter fit between the container and the base member comprises an artificial plant material.

14. The method of claim 11, wherein the means for encouraging a tighter fit between the container and the base member comprises a material configured to give the appearance of potting soil, grass, leaves, or rocks.

* * * * *